US009242499B2

(12) United States Patent
Nakanishi et al.

(10) Patent No.: US 9,242,499 B2
(45) Date of Patent: Jan. 26, 2016

(54) GLUE APPLICATION UNIT FOR PERFECT BINDING MACHINE

(75) Inventors: Hirohito Nakanishi, Shiga (JP); Kou Ohuchiyama, Shiga (JP); Takehito Yokogi, Shiga (JP); Akira Onodera, Shiga (JP)

(73) Assignee: HORIZON INTERNATIONAL INC., Shiga (JP)

( * ) Notice: Subject to any disclaimer, the term of this patent is extended or adjusted under 35 U.S.C. 154(b) by 76 days.

(21) Appl. No.: 14/233,605

(22) PCT Filed: Sep. 2, 2011

(86) PCT No.: PCT/JP2011/070001

§ 371 (c)(1),
(2), (4) Date: Jan. 17, 2014

(87) PCT Pub. No.: WO2013/031014

PCT Pub. Date: Mar. 7, 2013

(65) Prior Publication Data

US 2014/0199136 A1 Jul. 17, 2014

(51) Int. Cl.
*B42C 9/00* (2006.01)

(52) U.S. Cl.
CPC ..... *B42C 9/00* (2013.01); *B42C 9/0012* (2013.01); *B42C 9/0018* (2013.01)

(58) Field of Classification Search
CPC ..... B42C 9/0012
USPC ..... 412/37
See application file for complete search history.

(56) References Cited

U.S. PATENT DOCUMENTS

| | | | | |
|---|---|---|---|---|
| 2,746,879 | A | 5/1956 | Sieb | |
| 4,014,732 | A * | 3/1977 | Beckert et al. | 412/30 |
| 4,310,576 | A * | 1/1982 | Hesselmann et al. | 412/8 |
| 4,925,355 | A * | 5/1990 | Faber et al. | 412/37 |
| 5,702,220 | A * | 12/1997 | Combs | 412/37 |

(Continued)

FOREIGN PATENT DOCUMENTS

| | | | |
|---|---|---|---|
| DE | 2257614 | * | 5/1974 |
| GB | 02714 | A | 2/1916 |

(Continued)

OTHER PUBLICATIONS

English translation of Written Opinion dated Nov. 29, 2011, issued on corresponding application No. PCT/JP2011/070001 (4 pages).

(Continued)

*Primary Examiner* — Kyle Grabowski
(74) *Attorney, Agent, or Firm* — Westerman, Hattori, Daniels & Adrian, LLP

(57) ABSTRACT

The glue application unit comprises side glue application members which have a pair of scrapers (7, 7) and can engage with the back margins (s) of the book block (P). The scrapers consist of elastic rod-like bodies (7*a*) and scraping portions (7*b*) provided at leading ends of the bodies. The scrapers obliquely extending in a direction of movement of the book block from the outside of the path of the downwardly protruding portion of the book block into the path in such a way that the scrapers contact each other in an inverted V shaped configuration. The scraping portions engage with the back margins of the book block by the elastic biasing of the bodies while the downwardly protruding portion of the book block passes between the scrapers.

7 Claims, 6 Drawing Sheets

(56) References Cited

U.S. PATENT DOCUMENTS

| | | | | |
|---|---|---|---|---|
| 6,419,437 | B1 * | 7/2002 | Su | 412/37 |
| 2002/0061241 | A1 | 5/2002 | Fischer et al. | |
| 2006/0156974 | A1 * | 7/2006 | Muller-Lorenschat et al. | 118/261 |
| 2009/0297297 | A1 | 12/2009 | Katayama et al. | |

FOREIGN PATENT DOCUMENTS

| | | | |
|---|---|---|---|
| JP | 56-144660 | | 10/1981 |
| JP | 09-024682 | A | 1/1997 |
| JP | 2002-192041 | A | 7/2002 |
| JP | 2009-285906 | A | 12/2009 |

OTHER PUBLICATIONS

International Search Report dated Nov. 29, 2011, issued in corresponding application No. PCT/JP2011/070001.

Extended European Search Report dated Apr. 30, 2015, issued in corresponding application No. 11871388.2. (4 pages).

* cited by examiner (A)

(B)

(C)

GLUE APPLICATION UNIT FOR PERFECT BINDING MACHINE

TECHNICAL FIELD

The present invention relates to a glue application unit for a perfect binding machine.

BACKGROUND ART

One of perfect binding machines which are well-known in the prior art is provided with a series of binding units and at least one clamp unit serially moving through the binding units, wherein a book block is held between a pair of clamp plates of the clamp unit and then, while the book block is conveyed by the clamp unit along the series of binding units, the perfect binding is performed (cf. for example, Patent Document 1).

FIG. 6 is a plan view schematically showing the configuration of the conventional perfect binding machine. Referring to FIG. 6, the perfect binding machine comprises a series of binding units (a milling unit B, a glue application unit C and a cover attachment unit D) which are arranged along a conveying path F, a single clamp unit 31 arranged for reciprocal movement along the conveying path F, and a drive mechanism (not shown) moving the clamp unit 31 along the conveying path F. The clamp unit 31 has stationary and movable clamp plates 31*a*, 31*b*, and a motor M1 for moving the movable clamp plate 31*b* in directions toward and away from the stationary clamp plate 31*a*.

When the perfect binding is started, at a book block insertion position A, a book block (not shown) is inserted between the pair of clamp plates 31*a*, 31*b* of the clamp unit 31 and placed on an alignment plate 31*c* with its back face downwardly facing. Then the book block is held between the clamp plates 31*a*, 31*b* in such a way that back margins, which are located at both sides of the back face of the book block, protrudes downwardly from the clamp unit 31, and then conveyed by the clamp unit 31 toward the milling unit B along the conveying path F.

The milling unit B has a milling cutter 32*a*, a pair of stationary and movable guide plates 32*b*, 32*c*, and a motor M2 for moving the movable guide plates 32*c* in directions toward and away from the stationary guide plate 32*b*. While the book block moves through the milling cutter 32*a*, both sides of the book block protruding between the pair of clamp plates 31*a*, 31*b* passes between the pair of guide plates 32*b*, 32*c*. Thus the back face of the book block is cut while the book block is supported by the pair of guide plates 32*b*, 32*c* at the both sides thereof. After that, the book block is conveyed to the adhesive application unit C by the clamp unit 31.

The glue application unit C has a glue tank 33*a* filled with glue, a glue applying roller 33*b*, stationary and movable side glue applying rollers 33*c*, 33*d*, a motor M3 for moving the movable side glue applying roller 33*d* in directions toward and away from the stationary side glue applying roller 33*c*, and a roller 33*e* wiping off an excessive adhesive. When the application of glue is completed, the book block is conveyed to the cover attachment unit D by the clamp unit 31.

The cover attachment unit D includes a bottom plate 34*c*, stationary and movable nip plates 34*a*, 34*b*, and a motor M4 for moving the movable nip plate 34*b* in directions toward and away from the stationary nip plate 34*a*.

A cover supply unit E includes a tray on which a cover Q is placed, and a cover feed mechanism conveying the cover Q from the tray onto the bottom plate 34*c* and the pair of nip plates 34*a*, 34*b* of the cover attachment unit D.

The cover feed mechanism has a pair of fold line forming rollers 35*a*, 35*b* for forming fold lines at predetermined positions on the cover Q. The fold line forming rollers 35*a*, 35*b* are composed of a stationary fold line forming roller 35*a* and a movable fold line forming roller 35*b*. The movable fold line forming roller 35*b* is moved by a motor M5 in directions toward and away from the stationary fold line forming roller 35*a*.

The perfect binding machine includes a thickness measurement unit 36 for measuring a thickness of the book block. Prior to the start of the bookbinding operation of the machine, a thickness of the book block is measured by an operator through the use of the thickness measurement unit 36. Thus, a gap between the pair of clamp plates 31*a*, 31*b*, a gap between the pair of guide plates 32*b*, 32*c* of the milling unit B, a gap of the pair of side glue applying rollers 33*c*, 33*d* of the glue application unit C, a gap between the pair of nip plates 34*a*, 34*b* of the cover attachment unit D and a gap between the pair of fold line forming rollers 35*a*, 35*b* of the cover feed mechanism E are adjusted by a controller 37 based on the measurement value of the thickness of the book block.

Thus the book block is held between the pair of clamp plates 31*a*, 31*b* of the clamp unit 31 and then, while the book block is conveyed by the clamp unit 31 along the series of binding units B-D, the perfect binding is performed.

According to the glue application unit C of this perfect binding machine, prior to the start of the bookbinding operation of the machine, the gap between the pair of side glue application rollers 33*c*, 33*d* is adjusted such that the gap corresponds to the thickness of the book block to be bound. Therefore, if the back of the book block is undulated in its length direction although the book block is nipped between the pair of clamp plates 31*a*, 31*b*, the side glue application rollers 33*c*, 33*d* cannot engage with the back margins of the book block while being pushed against the back margins at a constant pressure throughout the length of the back margins during the passage of the book block over the glue application unit C, which causes a problem that the glue is unevenly applied to the back margins of the book block and the quality of the bookbinding is reduced.

Furthermore, in this glue application unit C, the gap between the pair of side glue application rollers 33*c*, 33*d* is adjusted by moving the movable side glue application roller 33*d* against the stationary side glue application roller 33*c* through the use of the motor M3, which complicates the gap adjustment mechanism, thereby raises the manufacturing cost of the glue application unit C and becomes a factor of growing the unit C in size.

PRIOR ART DOCUMENTS

Patent Documents

Patent Document 1: Japanese Laid-Open Patent Publication No. 2009-285906

SUMMARY OF THE INVENTION

Problems to be Solved by the Invention

It is an object of the present invention to assure a uniform application of the glue to the back margins located at both sides of the back face of the book block with reduction of the manufacturing cost of the glue application unit by simplifying the structure thereof.

Means for Solving the Problems

In order to achieve this object, according to the present invention, there is provided a glue application unit built in a perfect binding machine and arranged under a path of a clamp unit of the perfect binding machine so as to apply glue on back margins located at both sides of a back face of a book block as well as the back face while the clamp unit moves through the glue application unit, both the back face and the back margins protruding downwardly from the clamp unit, the glue application unit comprising: a frame; a glue tank attached to the frame and filled with glue; a glue application roller arranged in the glue tank and attached to the frame for rotation about a shaft thereof extending across the path of the clamp unit, the glue application roller applying the glue to the back face of the book block; a motor attached to the frame and rotating the glue application roller, a part of the glue application roller being soaked in the glue of the glue tank, the glue application roller engaging with the back face of the book block at its top face covered with the glue; side glue application members attached to the frame and arranged at both sides of a path of a portion of the book block protruding downwardly from the clamp so as to engage with the back margins of the book block, the side glue application members having a pair of scrapers, each of the scrapers being composed of an elastic rod-like or elongated plate-like body and a scraping portion provided at a leading end of the body, the scrapers obliquely extending in a direction of movement of the book block from the outside of the path of the downwardly protruding portion of the book block into said path in such a way that the scrapers cross each other in an inverted V shaped configuration to close off said path, tail ends of the bodies of the scrapers being attached to the frame or the glue tank outside said path, the scraping portions of the scrapers being positioned at the downstream of the top face of the glue application roller, whereby the scraping portions engage with the back margins of the book block by the elastic biasing of the bodies while the downwardly protruding portion of the book block passes between the scrapers.

According to a preferred embodiment of the present invention, a leading end portion of the rod-like body of each of the scrapers is bent downwardly and forms the scraping portion.

According to another preferred embodiment of the present invention, the scraping portion of each of the scrapers is a hollow or solid cylinder extending vertically, and the cylinder engages with the back margin of the book block at a part of an outer periphery thereof.

According to a further preferred embodiment of the present invention, a leading end portion of the elongated plate-like body of each of the scrapers is bent along a width direction thereof, and the resulting fold line forms a corner, and the corner forms the scraping portion, and the pair of the scrapers are attached to the frame in such a manner that the corners are opposite to each other.

According to a further preferred embodiment of the present invention, the scraping portion of each of the scrapers comprises: a roller receiving portion located at the leading end of the body, the roller receiving portion having upper and lower support surfaces which are arranged opposite to each other and an opening formed between the upper and lower support surface; and a scrape roller arranged in the opening of the roller receiving portion and attached between the upper and lower support surfaces for rotation about an axis extending vertically, an outer periphery of the scrape roller engaging with the back margin of the book block.

According to a further preferred embodiment of the present invention, the body of the scraper is fixed to a height-adjustable base at tail end thereof, the base being attached to the frame or the glue tank.

According to a further preferred embodiment of the present invention, the glue application unit further comprises: a wiper attached to the frame and located upstream of the top face of the glue application roller in a direction of the rotation of the glue application roller in such a way that the wiper can come into contact with and separate from the outer periphery of the glue application roller so as to change the thickness of the glue covering the top face of the glue application roller; and a wiper drive mechanism attached to the frame so as to actuate the wiper.

Effect of the Invention

According to the present invention, the pair of scrapers which cross each other in the inverted V shaped configuration always closes off the path of the portion of the book block downwardly protruding from the clamp unit, and during the clamp unit moves through the glue application unit, the downwardly protruding portion of the book block passes between the scrapers while pushing out the boundary of the scrapers against the elastic force of the bodies of the scrapers.

Consequently, for various book blocks of different thickness, the pair of scrapers engages certainly with the back margins of the book block, so that the uniform crosswise glue application along the length of the book block is achieved. Furthermore, even though the back of the book block is undulated along the length thereof, the scraping portions of the scrapers can follow the undulation of the back margins of the book block, and thereby the scraping portions certainly engage with the back margins of the book block during the passage of the clamp unit, so that the uniform crosswise glue application is achieved.

In addition, there is no necessity to provide a gap adjustment mechanism for the pair of scrapers because the gap between the pair of scrapers need not be adjusted according to the thickness of the book block, and thereby the structure of the glue application unit is simplified and the manufacturing cost thereof is reduced.

BEST MODE FOR CARRYING OUT THE INVENTION

Figure 1:
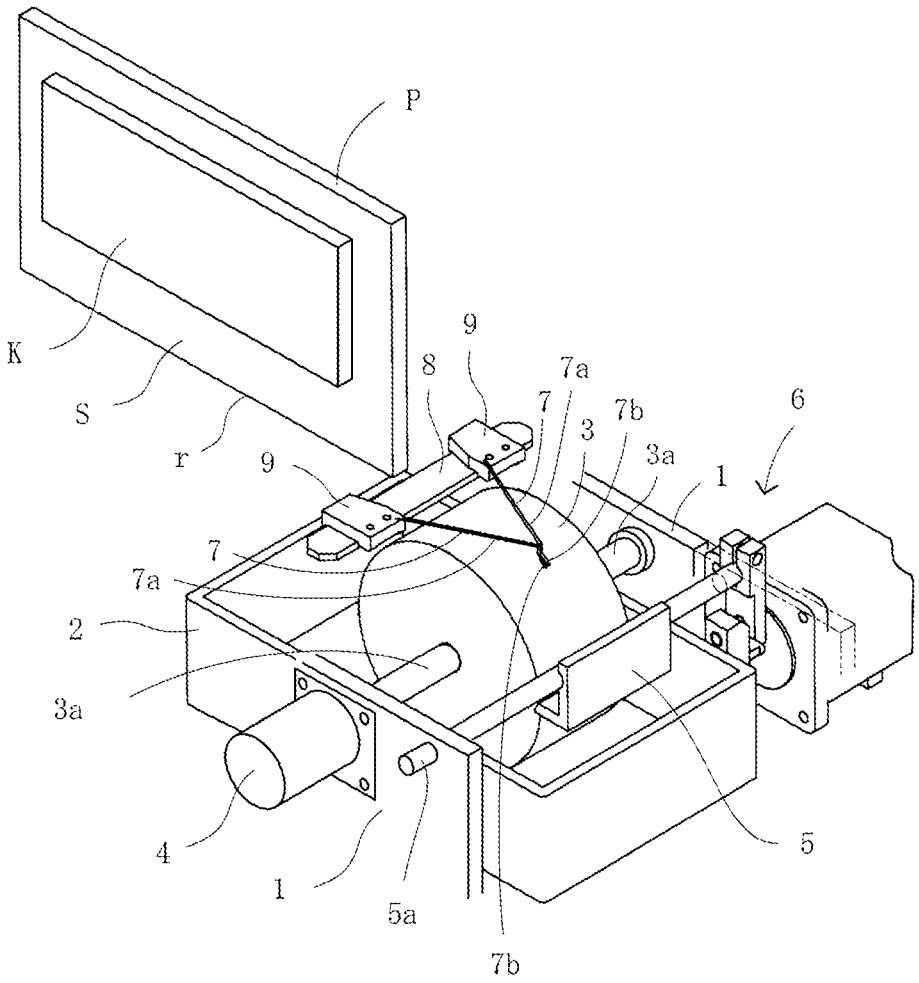
FIG. 1 is a perspective view schematically showing a structure of a glue application unit for a perfect binding machine in accordance with one embodiment of the present invention.
Figure 2:
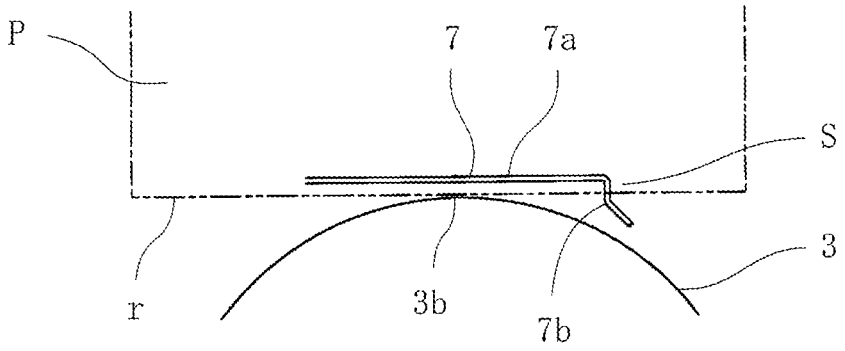
FIG. 2 is a side view schematically showing the glue application unit shown in FIG. 1, in which a book block moves through the unit.
Figure 3:
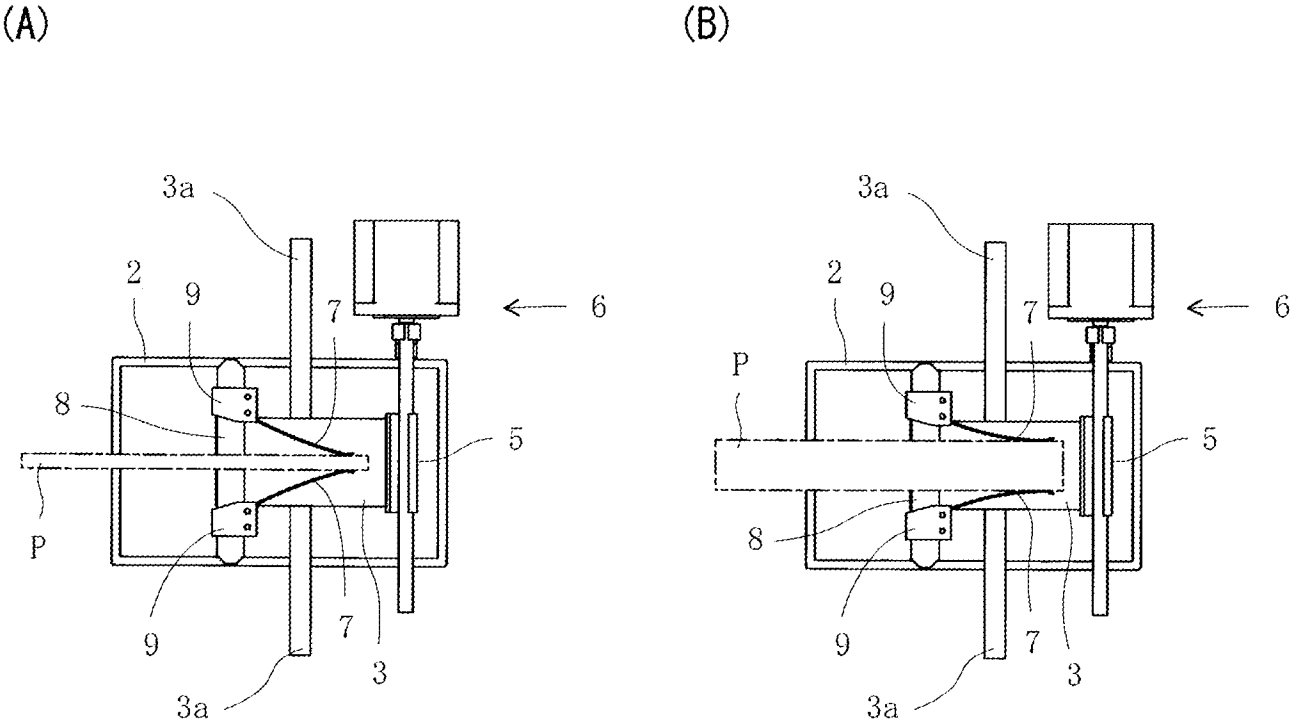
FIGS. 3A-3B are plan views schematically showing the glue application unit shown in FIG. 1, in which a book block moves through the unit.

A preferred embodiment of the present invention will be described below with reference to accompanying drawings. FIG. 1 is a perspective view showing a main part of a glue application unit of a perfect binding machine according to one embodiment of the present invention, and FIG. 2 is a side view of the glue application unit shown in FIG. 1, in which a book block moves through the unit. FIGS. 3A-3C are plan views showing a main part of the glue application unit shown in FIG. 1, in which a book block moves through the unit.

The glue application unit according to the present invention is built in a perfect binding machine and arranged under a path of a clamp unit K of the perfect binding machine and applies glue on back margins s located at both sides of a back face r of the book block P as well as the back face r while the clamp unit K moves through the glue application unit.

As shown in FIGS. 1 and 2, the glue application unit of the present invention comprises a frame 1, and a glue tank 2 attached to the frame 1 and filled with glue. The glue is a kind of glue which is melted by heating such as hot-melt adhesive. The glue tank is heated by a heater (not shown) in operation of the glue application unit.

The glue application unit also comprises a glue application roller 3 arranged in the glue tank 2 and attached to the frame 1 for rotation about its shaft 3*a* extending across the path of the clamp unit K. The glue application roller 3 applies the glue to the back face r of the book block P. The glue application unit further comprises a motor 4 attached to the frame 1 and connected to the shaft 3*a* of the glue application roller 3 so as to rotate the roller 3.

A part of the glue application roller 3 is soaked in the glue of the glue tank 2 and the glue application roller 3 engages with the back face r of the book block P at its top face covered with the glue. The glue application roller 3 is rotated by the motor 4 at a constant rate in the same direction as or a direction opposite to the direction of motion of the clamp unit K. In the embodiment shown in FIG. 1, the glue application roller 3 is rotated in a direction opposite to the direction of motion of the clamp unit K.

The glue application unit also comprises a wiper 5 attached to the frame 1 and arranged upstream of the top face of the glue application roller 3 in a direction of the rotation of the glue application roller 3 in such a way that the wiper 5 can come into contact with and separate from the outer periphery of the glue application roller 3, and a wiper drive mechanism 6 attached to the frame 1 so as to actuate the wiper 5. A distance between the wiper 5 and the outer periphery of the glue application roller 3 is adjusted so as to change the thickness of the glue covering the top face of the glue application roller 3. The wiper 5 and the wiper drive mechanism 6 are provided as necessary.

The glue application unit further comprises side glue application members attached to the frame 1 and arranged at both sides of a path of a portion of the book block P so as to engage with the back margins s of the book block P. Thus, after application of the glue to the back face r of the book block P, the glue which protrudes from the both sides of the back face r is applied to the back margins s by the side glue application members.

According to the present invention, the side glue application members having a pair of scrapers 7, 7. In this embodiment, the scraper 7 is composed of an elastic rod-like body 7*a* and a scraping portion 7*b* provided at a leading end of the body 7*a*. The scraping portion 7*b* consists of the leading end portion of the body 7*a* which is bent downwardly at a right angle and further bent forward and obliquely downward. Although the scraping portion 7*b* consists of the leading end of the body 7*a* which is bent downwardly twice in this embodiment, it is possible to form the scraping portion 7*b* by downwardly bending the leading end of the body 7*a* at any angle and an arbitrary number of times.

As shown in FIG. 1, the scrapers 7, 7 obliquely extend in a direction of movement of the book block P from the outside of the path of the downwardly protruding portion of the book block P into such path in such a way that the scrapers 7, 7 cross each other in an inverted V shaped configuration to close off such path. Then tail ends of the bodies 7*a*, 7*a* of the scrapers 7, 7 are attached to the frame 1 or the glue tank 2 outside such path, and the scraping portions 7*b*, 7*b* of the scrapers 7, 7 are positioned at the downstream of the top face 3*b* of the glue application roller 3.

In this embodiment, a support plate 8 is attached to the frame 1 below the path of a portion of the book block P protruding downwardly from the clamp K and extends across the direction of movement of the book block P. Support bases 9 are arranged at both side of such path and attached to the support plate 8, and the tail ends of the bodies 7*a* of the associated scrapers 7 is fixed to the support bases 9. In this case, each of the support bases 9 may be height-adjustable.

According to the present invention, the pair of scrapers 7, 7 which cross each other in the inverted V shaped configuration always closes off the path of the portion of the book block P downwardly protruding from the clamp unit K, and during the clamp unit K passes the glue application unit, the downwardly protruding portion of the book block P passes between the scrapers 7, 7 while pushing out the boundary of the scrapers 7, 7 against the elastic force of the bodies 7*a*, 7*a* of the scrapers 7, 7.

Thus, as shown in FIGS. 3A and 3B, for various book blocks of different thickness, the pair of scrapers 7, 7 engages certainly with the back margins s of the book block P. Consequently, the glue which protrudes from both sides of the back face r of the book block P after application of the glue to the back face r is applied uniformly to the back margins s of the book block P while being wiped by the scrapers 7, 7. Furthermore, even though the back of the book block P is undulated along the length thereof, the scraping portions 7*b*, 7*b* of the scrapers 7, 7 can follow the undulation of the back margins s of the book block P, and thereby the scraping portions 7*b*, 7*b* certainly engage with the back margins s during the passage of the clamp unit K, so that the uniform crosswise glue application is achieved.

Furthermore, there is no necessity to provide a gap adjustment mechanism for the pair of scrapers 7, 7 because the gap between the pair of scrapers 7, 7 need not be adjusted according to the thickness of the book block, so that the structure of the glue application unit is simplified and the manufacturing cost thereof is reduced.

Although the present invention has been explained based on one preferred embodiment thereof, the structural features of the present invention are not limited to this embodiment. One skilled in the art can easily devise various modified embodiments within the scope of the claims of the present application.

Figure 4:
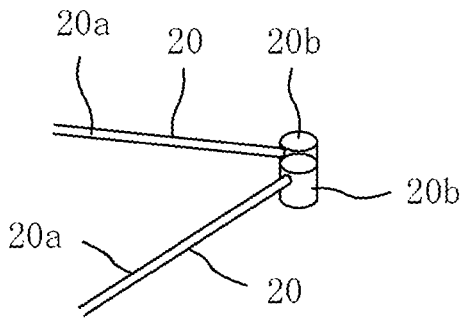
FIG. 4A-4C are perspective views of modified embodiments of a scraper.
Figure 4:
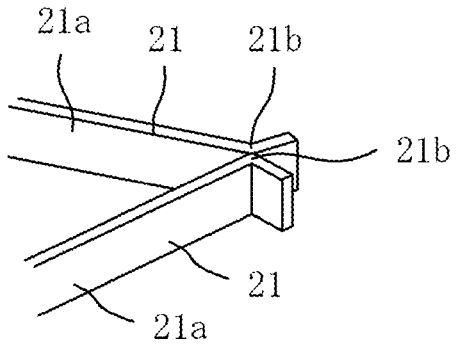
Figure 4:
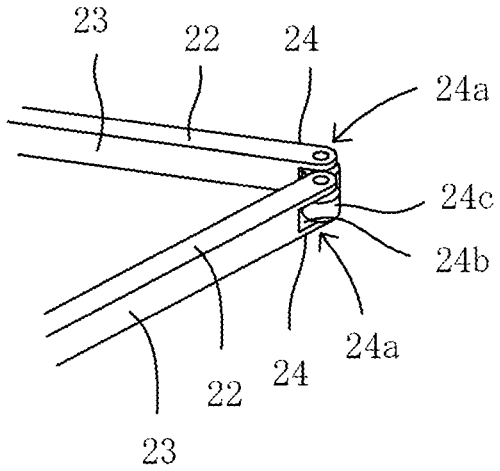
Figure 5:
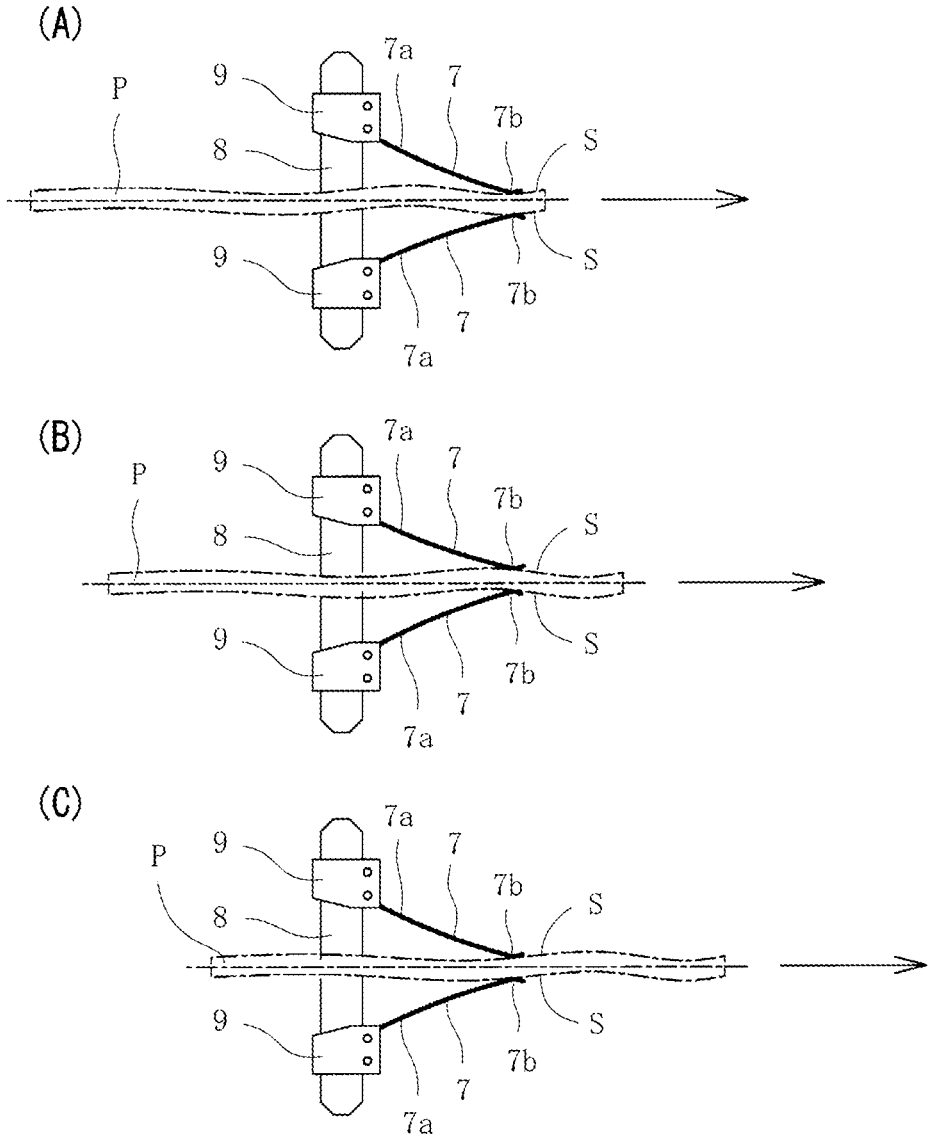
FIG. 5A-5C are plan views showing a state in which a book block whose back is undulated along its length passes between the scrapers of the glue application unit shown in FIG. 1.
Figure 6:
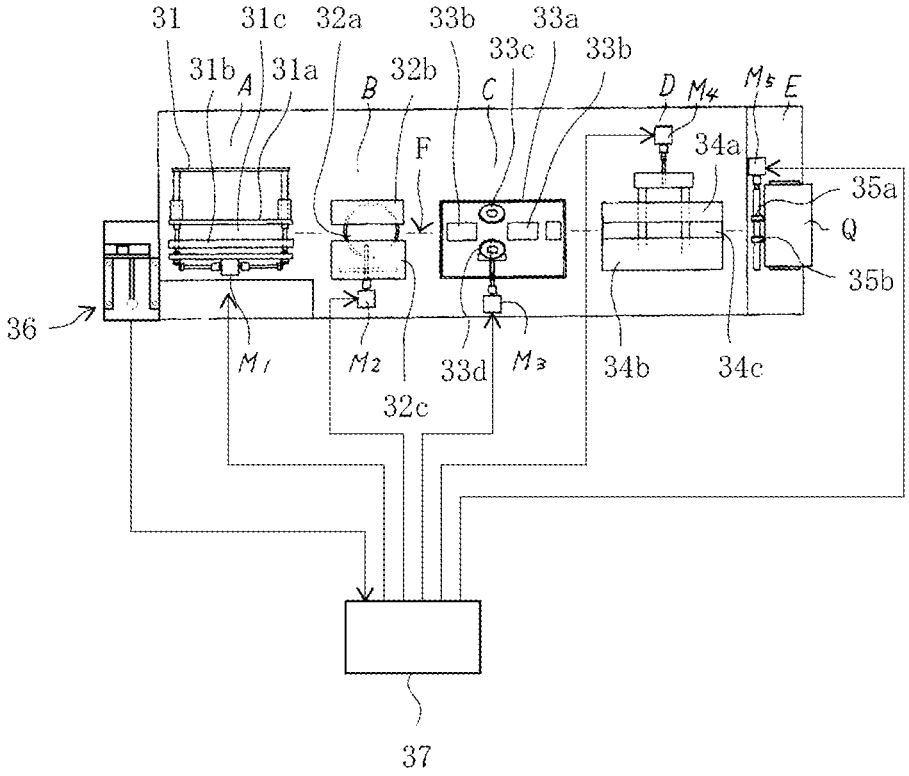
FIG. 6 is a plan view schematically showing a structure of a conventional perfect binding machine.

For example, according to a further preferred embodiment of the present invention, as shown in FIG. 4A, the body 20*a* of each of the scrapers 20 is an elastic rod, and the scraping portion 20*b* is a hollow or solid cylinder provided at a leading end of the body 20*a* and extending vertically. The scraping portion (cylinder) 20*b* engages with the back margin s of the book block P at a part of an outer periphery thereof.

According to a further embodiment of the present invention, as shown in FIG. 4B, each of the scrapers 21, 21 comprises an elongated elastic plate-like body 21*a*. A leading end of the body 21*a* is bent along a width direction thereof and the resulting fold line forms a corner 21*b*. The corner 21*b* forms the scraping portion. Thus the pair of the scrapers 21, 21 are attached to the frame 1 in such a manner that the scraping portions (corners) 21*b*, 21*b* are opposite to each other.

According to a further embodiment of the present invention, as shown in FIG. 4C, the body 23 of each of the scrapers 22 is an elongated elastic plate, and the scraping portion 24 comprises a roller receiving portion 24*a* located at the leading end of the body 23. The roller receiving portion 24*a* has upper and lower support surfaces which are arranged opposite to each other and an opening 24*b* formed between the upper and lower support surface. The scraping portion 24 further comprises a scrape roller 24*c* arranged in the opening 24*b* of the roller receiving portion 24*a* and attached between the upper and lower support surfaces for rotation about an axis extending vertically. An outer periphery of the scrape roller 24*c* engages with the back margin s of the book block P.

DESCRIPTION OF REFERENCE SIGNS

1 Frame
2 Glue tank
3 Glue application roller
3*a* Shaft
3*b* Top face
4 Motor
5 Wiper
5*a* Axis
6 Wiper drive mechanism
7 Scraper
7*a* Body
7*b* Scraping portion
8 Support plate
9 Support base
20 Scraper
20*a* Body
20*b* Scraping portion (Cylinder)
21 Scraper
21*a* Body
21*b* Scraping portion (Corner)
22 Scraper
23 Body
24 Scraping portion
24*a* Roller receiving portion
24*b* Opening
24*c* Scraping roller
K Clamp unit
P Book block
r Back face
s Back margin

The invention claimed is:

1. A glue application unit built in a perfect binding machine and arranged under a path of a clamp unit of the perfect binding machine so as to apply glue on back margins located at both sides of a back face of a book block as well as the back face while the clamp unit passes through the glue application unit, both the back face and the back margins protruding downwardly from the clamp unit, the glue application unit comprising:

a frame;

a glue tank attached to the frame and filled with glue;

a glue application roller arranged in the glue tank and attached to the frame for rotation about a shaft thereof extending across the path of the clamp unit, the glue application roller applying the glue to the back face of the book block;

a motor attached to the frame and rotating the glue application roller, a part of the glue application roller being soaked in the glue of the glue tank, the glue application roller engaging with the back face of the book block at its top face covered with the glue;

side glue application members attached to the frame and arranged at both sides of a path of a portion of the book block protruding downwardly from the clamp so as to engage with the back margins of the book block, the side glue application members having a pair of scrapers, each of the scrapers being composed of an elastic rod-like or elongated plate-like body and a scraping portion provided at a leading end of the body, the scrapers obliquely extending in a direction of movement of the book block from the outside of the path of the downwardly protruding portion of the book block into said path in such a way that the scrapers contact each other in an inverted V shaped configuration to close off said path, tail ends of the bodies of the scrapers being attached to the frame or the glue tank outside said path, the scraping portions of the scrapers being positioned at the downstream of the top face of the glue application roller, whereby the scraping portions engage with the back margins of the book block by the elastic biasing of the bodies while the downwardly protruding portion of the book block passes between the scrapers.

2. The glue application unit according to claim 1, wherein a leading end portion of the rod-like body of each of the scrapers is bent downwardly and forms the scraping portion.

3. The glue application unit according to claim 1, wherein the scraping portion of each of the scrapers is a hollow or solid cylinder extending vertically, and the cylinder engages with the back margin of the book block at a part of an outer periphery thereof.

4. The glue application unit according to claim 1, wherein a leading end portion of the elongated plate-like body of each of the scrapers is bent along a width direction thereof, and the resulting fold line forms a corner, and the corner forms the scraping portion, and the pair of the scrapers are attached to the frame in such a manner that the corners are opposite to each other.

5. The glue application unit according to claim 1, wherein the scraping portion of each of the scrapers comprises:

a roller receiving portion located at the leading end of the body, the roller receiving portion having upper and lower support surfaces which are arranged opposite to each other and an opening formed between the upper and lower support surface; and a scrape roller arranged in the opening of the roller receiving portion and attached between the upper and lower support surfaces for rotation about an axis extending vertically, an outer periphery of the scrape roller engaging with the back margin of the book block.

6. The glue application unit according to claim 1, wherein the body of the scraper is fixed to a height-adjustable base at tail end thereof, the base being attached to the frame or the glue tank.

7. The glue application unit according to claim 1, further comprising:

a wiper attached to the frame and located upstream of the top face of the glue application roller in a direction of the rotation of the glue application roller in such a way that the wiper can come into contact with and separate from the outer periphery of the glue application roller so as to change the thickness of the glue covering the top face of the glue application roller; and a wiper drive mechanism attached to the frame so as to actuate the wiper.

* * * * *